US006223469B1

(12) United States Patent
Moll

(10) Patent No.: US 6,223,469 B1
(45) Date of Patent: May 1, 2001

(54) PIVOT-HUNG DOOR DRIVE

(75) Inventor: Oliver Moll, Solingen (DE)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/378,161

(22) Filed: Aug. 19, 1999

Related U.S. Application Data

(63) Continuation of application No. PCT/EP98/08236, filed on Dec. 16, 1998.

(30) Foreign Application Priority Data

Dec. 19, 1997 (DE) ..... 197 56 496

(51) Int. Cl.[7] ..... E05F 11/24
(52) U.S. Cl. ..... 49/341; 49/339
(58) Field of Search ..... 49/336, 337, 338, 49/339, 340, 341, 342, 343

(56) References Cited

U.S. PATENT DOCUMENTS

| | | | | |
|---|---|---|---|---|
| 4,220,051 | | 9/1980 | Catlett . | |
| 4,580,365 | | 4/1986 | Sieg . | |
| 4,876,764 | | 10/1989 | Teague, Jr. . | |
| 4,972,629 | | 11/1990 | Merendino et al. . | |
| 4,995,194 | * | 2/1991 | Schultze et al. | 49/32 |
| 5,513,467 | | 5/1996 | Current et al. . | |
| 5,687,507 | | 11/1997 | Beran . | |
| 5,862,630 | * | 1/1999 | Krumhauer et al. | 49/341 |
| 5,873,200 | * | 2/1999 | Henderson | 49/343 |

FOREIGN PATENT DOCUMENTS

| | | |
|---|---|---|
| 3730114 | 5/1988 | (DE) . |
| 4231984 | 3/1994 | (DE) . |
| 296 04 692 U | 6/1996 | (DE) . |
| 29521068 | 9/1996 | (DE) . |

* cited by examiner

*Primary Examiner*—Daniel P. Stodola
*Assistant Examiner*—Curtis A. Cohen
(74) *Attorney, Agent, or Firm*—Nils H. Ljungman & Associates

(57) ABSTRACT

Pivot-hung door drive system with an electronic control system that contains at least one memory and one microprocessor, for an at least single-panel door, the door panel of which is driven by an electro-mechanical drive unit that acts in the opening and closing directions. The drive unit consists essentially of a drive motor with a transmission and a power transmission unit for the door connected to it, whereby the power transmission unit consists of a drive shaft which is connected with one end of an actuator lever and the pivot-hung door drive system is installed inside a door panel or inside a door frame or casing. The power transmission unit consists of a screw with a nut that partly surrounds it, which nut is positively and non-positively connected to a toothed rack, whereby the drive shaft is engaged with its gear teeth in the gear teeth of the toothed rack.

15 Claims, 6 Drawing Sheets

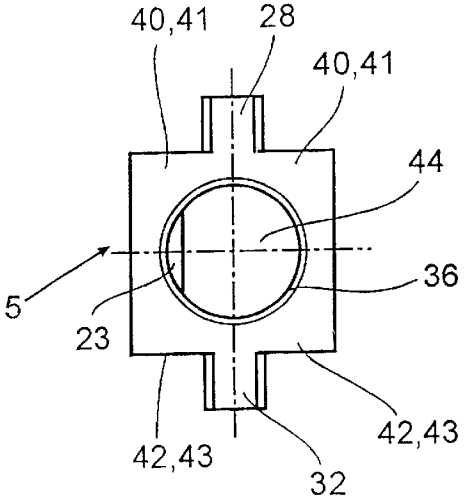
Fig.6
Fig.7
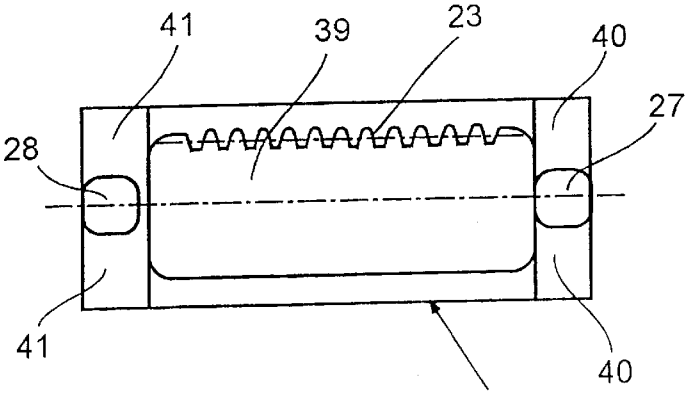
Fig.8
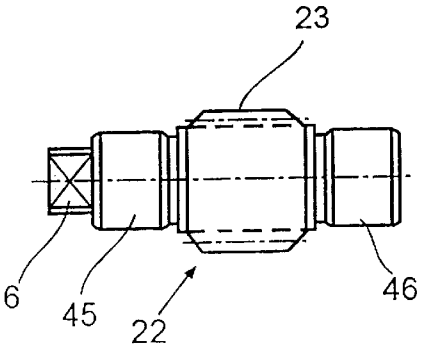
Fig.9
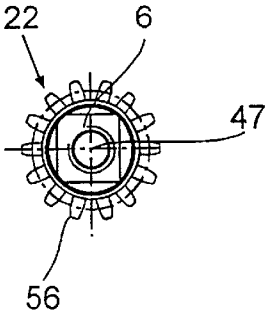
Fig.10

PIVOT-HUNG DOOR DRIVE

This application is a Continuation of PCT/EP98/08236 filed Dec. 16, 1998.

BACKGROUND OF THE INVENTION

1. Field of the Invention

The present invention relates to a concealed drive system for a pivot-hung door with an electronic control and/or regulation system that contains at least one memory and one microprocessor for an at least single-panel door. The door panel of the single-panel door is driven by an electro-mechanical drive unit that acts in the opening and closing directions, whereby the drive unit consists essentially of a drive motor with a force transmission unit connected to it, and the force transmission unit has a drive shaft that is connected with one end of an actuator lever. The entire pivot-hung door drive system is installed in a concealed manner inside a door panel or inside a casing.

2. Background Information

The purpose of automatic door drive systems is to make it easier to open and close the doors. Such automatic door drive systems are gaining importance not only in buildings used for public and business purposes, such as, for example, office buildings, hospitals and residential facilities for older people, but automatic door drive systems are also being installed with increasing frequency in homes and apartments that are equipped for access by the physically disabled. For this purpose, the door drive systems are essentially always mounted on the door panel or above the door frame or casing.

German Patent No. DE 42 31 984 A discloses an electro-mechanical pivot-hung door drive system that is equipped with a data processing unit for optimal operation. Connected with the data processing unit is a motor control unit that transmits its output signal to a geared motor. The process of opening such a pivot-hung door is thereby initiated by means of a sensor signal, and is automatically executed by the drive system. Simultaneous with the opening, an energy storage device is supplied with the necessary energy so that such a door can be returned to a secure closed position without the input of additional electrical energy. In the event of a failure of the motor control unit, it is thereby also possible to close the driven door panel securely even in the absence of outside power.

German Patent No. DE 296 04 692 U1 discloses a device for the actuation of a window panel. For this purpose, chain elements are embedded in the panel, and are moved by a worm gear of a motor provided with a gear train.

German Utility Model 295 21 068 describes a drive system for a pivot-hung door installed in emergency escape routes. In this case, a drive system is used that moves only in the direction of opening the pivot-hung door, and thereby simultaneously supplies a power storage mechanism in the form of a spring element with the necessary energy, so that following the opening process, including the potential length of time the pivot-hung door is held open, the door can be properly closed again without additional energy. The entire drive unit is thereby installed in a concealed manner above the pivot-hung door and inside the frame. The pivot-hung door is driven either directly by the drive shaft of the drive system, or by means of an actuator arm inside the profile of the door, which interacts with a sliding piece that can move in a slide rail.

On the drive system there is also a device that makes it possible, by applying a manual force, to uncouple the pivot-hung door from the drive system beyond the closed position. This device is a mechanical coupling that transmits force only in one direction. The coupling thereby consists of a locking pin that is attached positively and non-positively to the drive shaft, and at least one locking notch in the locking pin. Inside the locking notch there is a pin that is spring-loaded and is provided with a continuously adjustable force. The force adjustment capability makes it possible to adjust the release force continuously.

In an additional embodiment, it is also possible that the upper crossbar of the pivot-hung door can be provided with two hook-shaped support arms that are engaged with each other. The support arms are thereby engaged with each other so that the pivot-hung door can also be uncoupled from the drive system only in one direction, namely in the direction of the emergency escape route.

The problem with such door drive systems, however, is that plans for the incorporation of such drive systems must be made as early as during the design of the building, because otherwise it is impossible to have the required passage height.

OBJECT OF THE INVENTION

The object of the invention is to create an automatic drive system that is very small for a pivot-hung door, and the appearance of which does not adversely affect the architectonic appearance of a door. It must also be possible to manufacture such a pivot-hung door drive system economically and to operate it with little or no maintenance.

SUMMARY OF THE INVENTION

The present invention teaches that this object can be accomplished by a pivot-hung door drive system with an electronic control system that contains at least one memory and one microprocessor, for an at least single-panel door, the door panel of which can be driven by an electro-mechanical drive unit. The electro-mechanical drive unit acts in the opening and closing directions, whereby the drive unit can include a drive motor with a transmission and a power transmission unit for the door connected to it, whereby the power transmission unit consists of a screw with a screw nut that partly surrounds the screw, which screw nut is positively and non-positively connected with a toothed rack, and a drive shaft can be engaged with its gear teeth in gear teeth of the toothed rack. The drive shaft can be connected with one end of an actuator lever and the pivot-hung door drive system can be installed inside a door panel or inside a door frame or casing. The dependent claims, and features hereinbelow, disclose appropriate refinements of the present invention.

An additional objective in the design of a compact pivot-hung door drive system was the ability to install the drive system in a concealed manner, which means that the pivot-hung door drive system can be embedded inside a door or casing. Modifications to the building, e.g. holes in the floor or walls, thereby preferably become unnecessary. The known art discloses door-closers, e.g. the "DORMA ITS 96", that are concealed inside doors or door frames. The torque is introduced into the door by means of a lever that is supported in a sliding rail. As a result of the transmission action of the sliding rail, in combination with this door closer, which has a reciprocating control cam, there is a decreasing opening moment. By means of the realization of the cam profile, it thereby becomes possible to design an almost unrestricted configuration of the torque curve.

To create a simple, economical drive system for a pivot-hung door, the invention can use a toothed rack with gear teeth that have a large modulus that is capable of transmitting the torques that occur on pivot-hung doors of this type. These gear teeth can be realized in a toothed rack that has a polygonal cross section, and is preferably mounted non-rotationally between two plates. The toothed rack can thereby be connected in a driving connection with a drive shaft that preferably has identical corresponding gear teeth and is mounted in the cover plates. As a result of the sliding motion of the toothed rack, the stationary drive shaft is rotated, and as a result of the connected lever, in connection with a slide that can be movably mounted in a slide rail, that causes the movements of the door. A screw or spindle or threaded nut can be positively and non-positively connected with the toothed rack for the movement in translation. Inside the screw nut a screw, preferably a recirculating ball screw, can be guided on one end, whereby the other end of the screw can be held in a mounting. The screw is thereby driven by a drive shaft that extends out of a transmission. The transmission can thereby be connected with a drive motor. To detect the position of the connected pivot-hung door, there can be a distance sensor on the pivot-hung door drive system, which sensor can preferably be an incremental sensor or a potentiometer. The motor can be actuated by a control system that contains a microprocessor and a memory and can be realized in the form of an SPS control (self-programming control) system. The control information can thereby be transmitted, for example, in the form of a sensor signal, by a transmitter that can be inside the sensor, to a receiver that can be embedded inside the control system, and thus can be inside the door panel. The pivot-hung door drive system is preferably equipped with a corresponding battery pack or a storage battery so that it can operate independently or in the absence of external power. In one application of the teaching of the invention, however, it is also possible for the power supply of the control system to be provided by means of corresponding feed lines that are realized in the form of cables and fed with the necessary energy. In such a case, the connection between the sensor and the control can also be realized by a cable, whereby the sensor can also be a switch.

For the sake of completeness, it should also be noted that such pivot-hung door drive systems preferably work in connection with a sliding rail or runner which can also be concealed, either in the casing or frame above the door or, if the pivot-hung door drive system is located inside the casing, the sliding rail system can be placed inside the door panel. The connection between the drive shaft and the sliding piece guided in the sliding rail can be provided by a lever arm.

If the control is then activated by the sensor signal, the screw rotates and thus causes a forced movement of the toothed rack, which in turn causes a forced movement as a result of the coupling by means of the lever, which is movably mounted on the other end on the slide piece. As a result of the pre-determined opening width, the door remains stopped at the angle determined by the drive system, and the door panel is simultaneously held in this position. This can be accomplished, for example, by using an irreversible transmission. It is also possible, however, with an appropriate regulation of the control system, for the drive motor to hold the door in the open position, and to automatically return it to the closed position after an adjustable length of time, although that can entail a higher energy consumption. Using the motor to keep the door open generates a corresponding amount of waste heat, which can result in an increase in the temperature of the motor. It is also possible to generate a holding moment by means of an electromagnetically switched coupling or by means of a brake.

To also be able to operate the door manually, e.g. by disabling the drive system, a corresponding tuning between the motor and transmission is necessary. The friction torque of the motor thereby acts against the movement of the door. However, if the combination of the gear drive and recirculating ball screw are effectively tuned, such a door can also be opened manually without requiring the application of a large amount of force.

The task of the control system in particular is to regulate the motor current or the motor voltage as a function of the position of the door and the demand signal, e.g. the signal from a sensor. In this case, the motor can be short-circuited when the door is closed, thereby making available an additional closing moment. If an opening signal is emitted, the motor current is regulated along the motor moment characteristic. After the specified maximum speed of rotation has been reached, the motor speed is kept constant on the basis of the data from the distance sensor in connection with a programmable sequence of operations which was defined when the door was first opened by a learning program, up to a braking point. When the door decelerates, the motor current must be limited to a lower level than during acceleration. To close the door, this process is repeated in the reverse direction. When the allowable motor current is increased, e.g. if the door encounters an obstacle, the control system correspondingly deactivates the drive, or moves the door into the reversing position. The limit positions of the door and the deceleration points of the control system are also determined as part of the learning phase.

To make it easy to operate the overall pivot-hung door drive system unit, both the drive unit, which includes in particular the toothed rack, the screw with the nut, the transmission, motor and distance sensor, and the control system as well as the power supply can be fastened to a cover. With such a system, i.e. when all the components of the pivot-hung door drive system lie in a line one behind the other and have been realized in the form of replaceable modules, a pivot-hung door drive system has been created that can be installed invisibly inside doors, frames etc. The pivot-hung door drive system can thereby have a maximum installed width of about 35 mm.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one possible exemplary embodiment which is illustrated in the accompanying drawings, in which:

FIG. 6 shows a toothed rack in a head-on view, FIG. 7 shows a toothed rack in a side view, FIG. 8 shows a toothed rack in an overhead view, FIG. 9 shows a drive shaft in a head-on view, FIG. 10 shows a drive shaft in an overhead view.

DESCRIPTION OF THE PREFERRED EMBODIMENT

Figure 1:
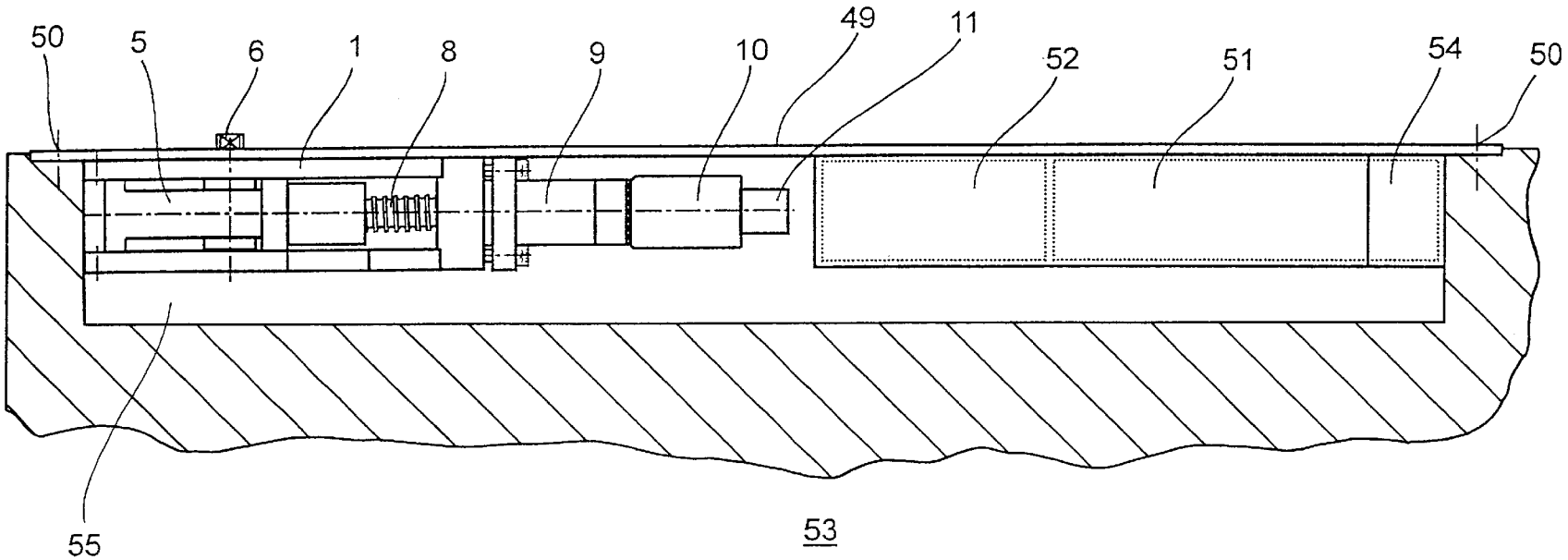
FIG. 1 shows a partial section through a door with an installed pivot-hung door drive system.

FIG. 1 shows a pivot-hung door drive system which is installed in a door 53 inside a recess 55. In the exemplary embodiment, the door in question is a wooden door. As a result of its intentionally small size, however, the pivot-hung door drive system can also be installed inside the frame of a profile door. It is also possible not to install the pivot-hung door drive system as illustrated in FIG. 1 inside a door 53, but in a casing above the door or in the door frame, which locations are not illustrated in the exemplary embodiment. The exemplary embodiment also does not include the attachment of the door 53, which can be by means of belts, nor the actuator arm which can slide back and forth with the sliding rail and its sliding piece located above it, nor the connection between the pivot-hung door drive system (door) and the stationary part, namely the casing. The recess 55 must be sized so that a cover 49 can be flush-mounted inside a depression, whereby both the pivot-hung door drive system and its drive unit, as well as a power supply 52 for a control unit 51 and a signal transmission device in the form of a receiver, if one is used, can be mounted on the cover 49. All the components are arranged in a line, i.e. one behind the other. The overall pivot-hung door drive system is positively and non-positively connected with the door 53 by means of the cover 49 and by means of threaded fasteners 50 that run through the cover 49.

Figure 2:
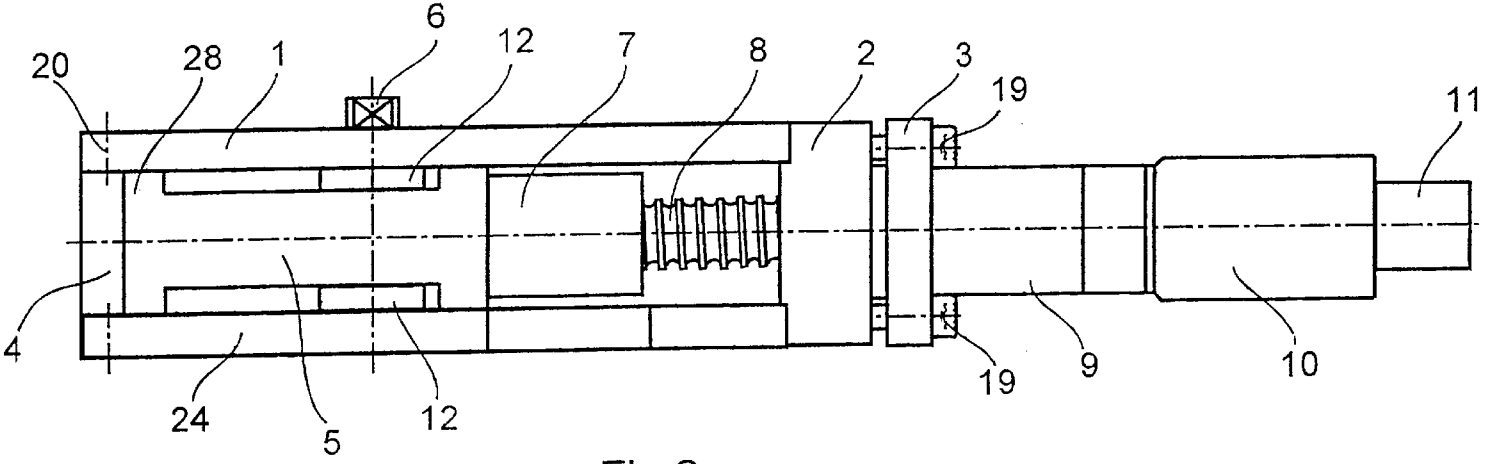
FIG. 2 shows a pivot-hung door drive system in a side view.

We shall first consider the mechanical part, namely the construction of the pivot-hung door drive system illustrated in FIG. 2. The pivot-hung door drive system is an electromechanical pivot-hung door drive system which is designed to move the connected door 53 by means of a drive motor 10 which is connected with a transmission 9. Because the pivot-hung door drive system is installed in a concealed manner inside a door panel or inside the casing, the housing that conventionally encloses the pivot-hung door drive can essentially be eliminated. The housing can consequently consist essentially of the structural elements from which the drive unit is preferably fabricated. These structure elements are in particular an upper cover plate 1 and a lower cover plate 24, whereby the cover plate 1 is on top in FIG. 2 and the cover plate 24 is on the bottom. The cover plates 1 and 24 are kept at a distance from one another on one end by a terminal piece 4 and on the other end by a bearing mount 2. The terminal piece 4 is thereby positively and non-positively held in place by means of threaded fasteners 20 between the cover plates 1 and 24.

The bearing mount 2 is provided by means of a bearing flange 3, to which the transmission 9 with the drive motor 10 is attached by means of threaded fasteners 19 that run through both the bearing flange 3 and also the bearing mount 2, and are screwed into corresponding threaded holes in the cover plates 1, 24. The device for the movement of the pivot-hung door drive system in translation thereby consists essentially of a toothed rack 5, a screw nut 7 and a screw 8 that is engaged inside the screw nut.

Figure 3:
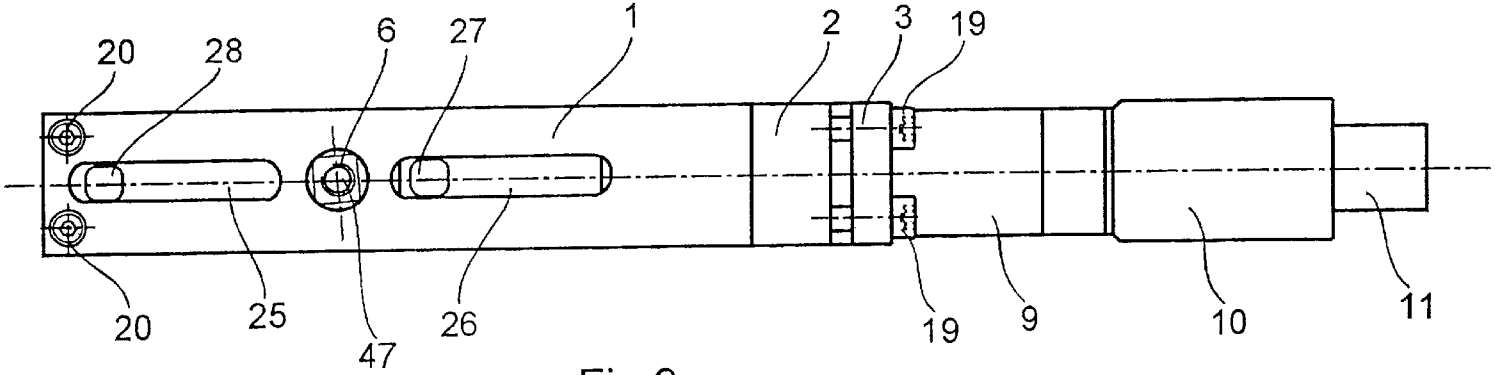
FIG. 3 shows a pivot-hung door drive system in an overhead view.
Figure 4:
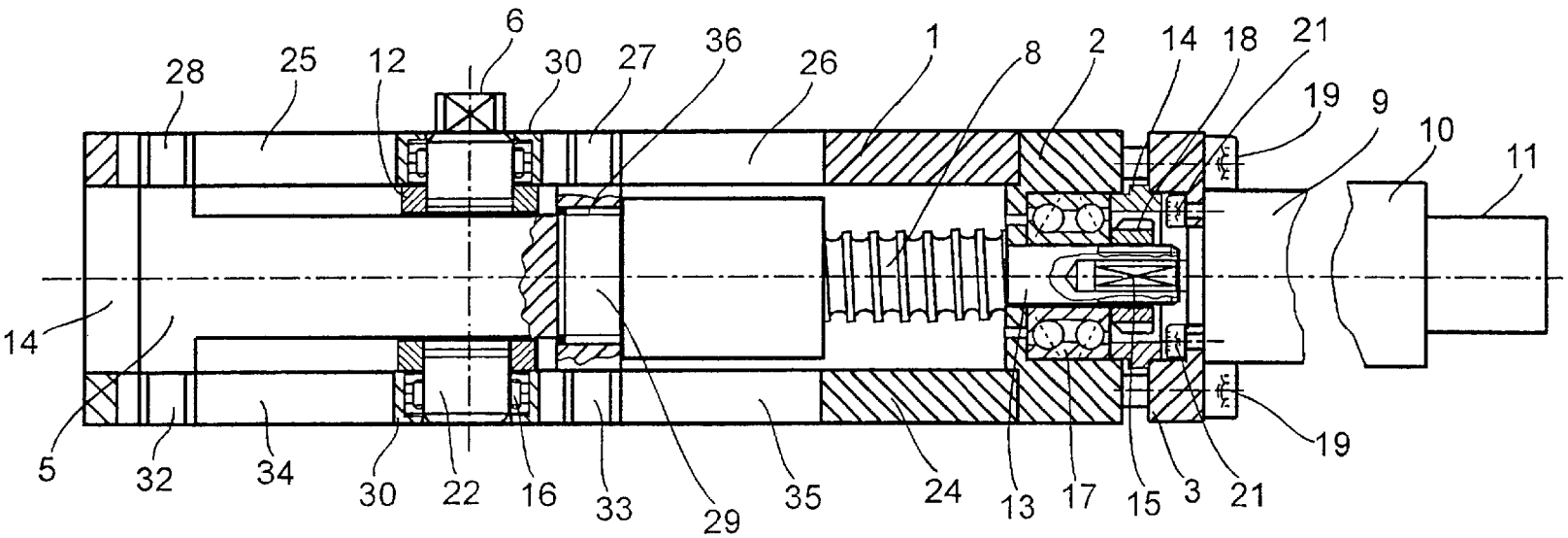
FIG. 4 shows a pivot-hung door drive system in a side view in a longitudinal and partial section.
Figure 5:
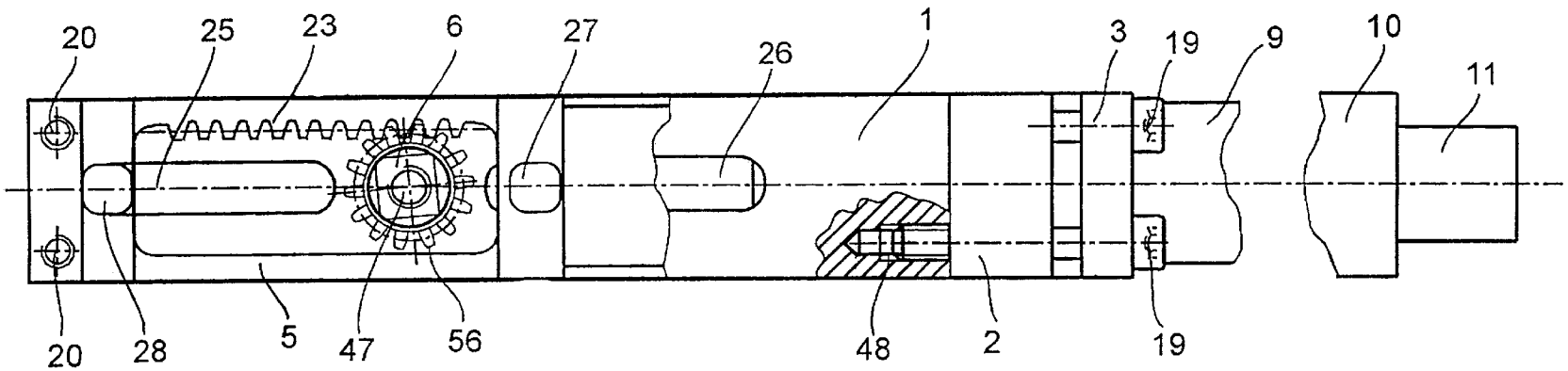
FIG. 5 shows a pivot-hung door drive system in an overhead view with a partial section through the cover plate.

The toothed rack 5 is thereby prevented from rotating by recesses 25 and 26 that are located in the cover plate 1 and by recesses 34 and 35 that are located in the cover plate 24, in each of which the toothed rack 5 is mounted in molded guide lugs 27, 28 and 32, 33 in the longitudinal direction of the pivot-hung door drive system (See FIGS. 3 and 4 in particular). Effectively connected to the toothed rack 5 is an output shaft 22 that projects with one end out of the cover plate 1 and has an actuator cam 6, to which the above-mentioned connection for the sliding rail (not shown) can be made by means of the actuator arm. The connection between the actuator arm and the actuator cam can be thereby secured against rotation by means of a threaded fastener that is screwed inside a threaded boring 47.

The toothed rack 5 thus slides with the surfaces 40, 41, 42, 43 located in the vicinity of the guide lugs 27, 28 and 32, 33 between the cover plates 1 and 24. The toothed rack 5 is illustrated in particular in FIGS. 6, 7 and 8, which show individual views of the toothed rack 5. In the middle area of the toothed rack 5 there is a penetration 39 that has gear teeth 23 on one side. The toothed rack 5 also tapers when viewed in the horizontal axis, namely in the form of recesses 37 and 38. On one of the end walls of the toothed rack 5 there is a screw nut locator 44 that is configured so that the screw nut 7 in this case can be connected positively and non-positively. This connection can be achieved, for example, by means of a thread 36. it is also possible, however, to manufacture the screw nut 7 and the toothed rack 5 in the form of a single piece.

Corresponding gear teeth 56 that have the same modulus and are located on the drive shaft are engaged with the gear teeth 23. This situation is illustrated in FIGS. 9 and 10. So that the drive shaft 22 can also be guided securely inside the cover plates 1 and 24, there are bearing surfaces 45, 46 on the drive shaft 22.

FIG. 4 shows a detailed illustration of the pivot-hung door drive system, in which the pivot-hung door drive system is shown in a side view. Selected areas are also shown in detail in a partial cross section. This figure shows particularly clearly the connection between the screw nut 7 and the toothed rack 5, whereby in this case, the connection selected was by means of the thread 36 on an extension 29 molded onto the screw nut 7. The screw 8 is engaged inside the screw nut 7, which screw 8 can preferably be a recirculating ball screw, to keep the friction losses as low as possible. The end of the screw 8 that does not penetrate the screw nut 7 is held in the bearing mount 2 by means of a bearing extension 13 inside a screw bearing 17. On the bearing extension 13, in the illustrated exemplary embodiment, there is an external thread, on which a screw washer 18 is screwed. This connection can also be in the form of other suitable securing means. Between the bearing mount 2 and the bearing flange 3 there is also a bearing mount 14 for compensation or equalization. The bearing mount 3 and the bearing mount 14 are held by the threaded fasteners 19 that run through them and are engaged inside the cover plates 1 and 24.

Inside the bearing flange 3, the transmission 9 is attached by means of threaded fasteners 21. The transmission 9 thereby has a drive shaft 15 which in the illustrated exemplary embodiment is inserted inside the bearing neck, or extension 13, in this case by means of a square, and thus the screw 8 also rotates when the drive shaft 15 is rotated. Alternatively, however, any other detachable positive and non-positive connection, in particular in the form of a tongue-and-groove connection, can also be used.

The drive shaft 22, as also shown in FIG. 4, is guided inside the cover plates 1 and 24 by means of bearings 16. The bearings 16 are thereby located in blind borings 30. With the actuator cam 6, the drive shaft 22 projects out of the cover plate 1. This design essentially ensures that the pivot-hung door drive system can be used both for DIN doors that open to the right and to the left.

If the drive motor is activated by means of the control system 51 in response to a sensor signal, then as a result of the rotation of the motor shaft and the connection via the transmission 9, the screw 8 is set in rotation. The screw nut 7 and thus also the toothed rack 5 in the exemplary embodiments illustrated in FIGS. 1, 2, 4 and 5 is pulled to the right, which simultaneously means that the drive shaft 22, because it is stationary, rotates and thus ensures an opening as a result of the connection (not shown) between the door panel 53 and the casing. At the same time, however, the angle of rotation of the door panel 53 is measured by a distance sensor 11. It is thereby ensured that the control system 51 is at all times aware of the opening angle of the door 53. Thus the control system 51 is able, after the door has been opened a specified width, to reduce its speed of rotation, and to stop the door 53 when it reaches a specified opening angle. So that the pivot-hung door drive can also operate independently in the event of a power failure, and as in the exemplary embodiment illustrated in FIG. 1, a power supply 52 in the form of a storage battery is used to keep the door in operation. If such a door is located in heavily traveled entrances, however, the capacity of a storage battery would not be sufficient, and in this case it is possible to provide the power supply with the operating energy required for the control system 51 and thus the drive motor 10 by means of cables.

When cables are used, the sensor can also be connected by cables, which means that the receiver 54 can be eliminated.

The connected door 53 is damped electrically. Because both the electro-mechanical drive system and the power supply and control system are installed inside the door 53 or the casing, no holes in the wall or the floor are required for installation. The pivot-hung door drive system can also be used for retrofitting existing buildings, because it can also be installed in existing doors, including profile frame doors, in which case it represents an attractive alternative to new doors, in particular for older people, as well as for the physically disabled.

Figure 11:
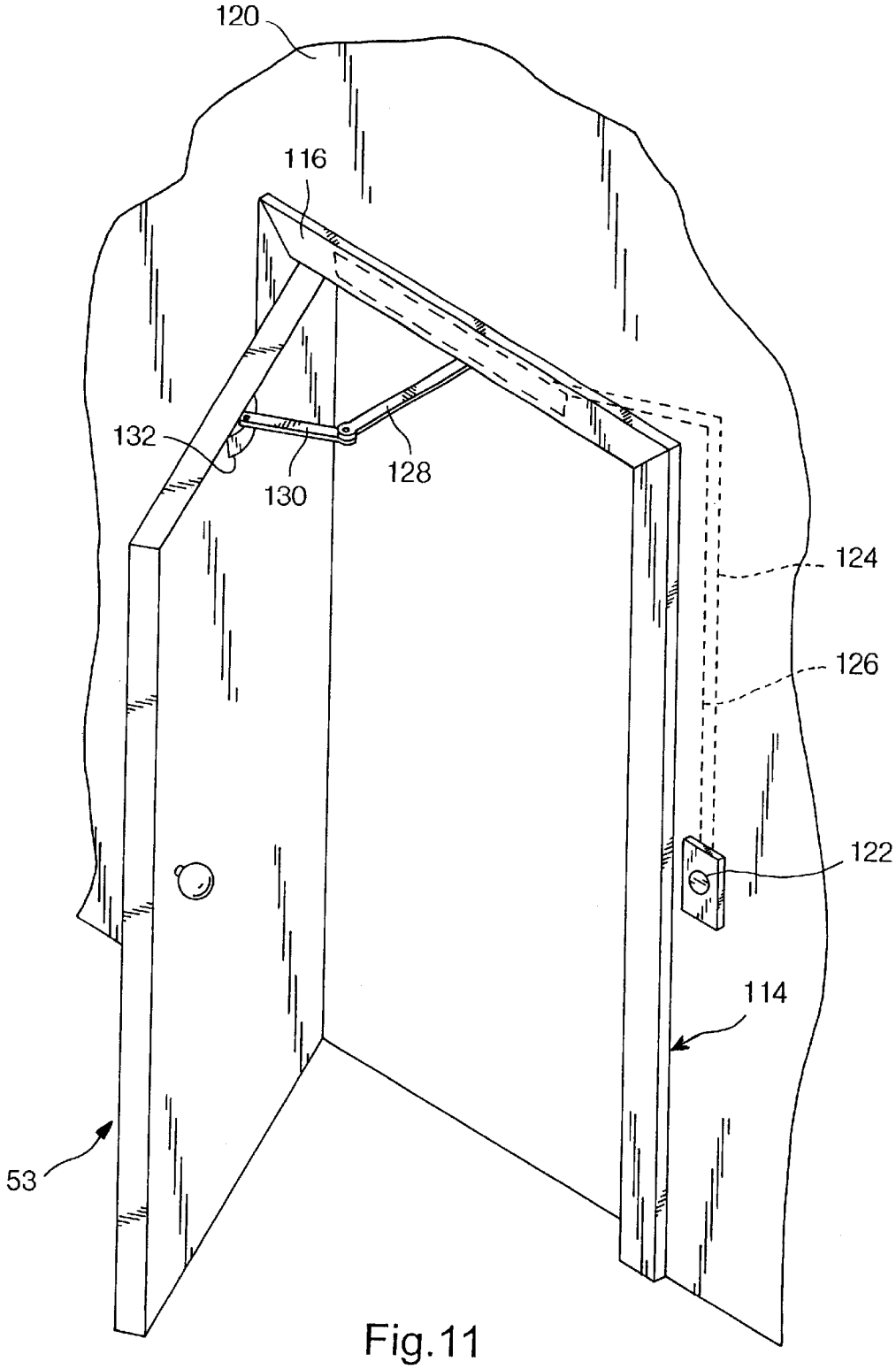
FIG. 11 shows schematically a possible embodiment of a pivot-hung door drive system installed in a door frame.

FIG. 11 shows schematically one possible embodiment of a pivot-hung door drive system installed in a door frame or door jamb section 116. In one embodiment of the present invention, the door drive system, in particular the control unit 51, can be in electrical communication with a switch 122 which can be provided on a wall 120 located adjacent the door frame 114. Suitable wires 124, 126 can connect the system to the switch 122 in the well-known manner. The arrangement can be such that a person desiring to enter through the door opening can either open the door manually, or in the alternative, need only press the switch 122 to activated the door drive system and open the door 53. Another possible embodiment can be to place a sensor in front of the door 53 which sensor can activate the door drive system in response to a person standing in front of the door.

In one possible embodiment, as shown in FIG. 11, the door drive system can connected to a first link arm 128 at an end thereof. The first link arm is pivotally connected to a second link arm 130 at an opposite end thereof which is attached to the door 53 by a bracket 132. As shown in FIG. 11, the door drive system can provide a rotating force on the first link arm 128, resulting in a rotation of the first link arm 128 and the opening of the door 53. Additionally, in other possible embodiments, the link arms 28 30 can be replaced by other known opening/closing arrangements. For example, as explained above, it is well-known to use only one link arm slidably connected within a track (not shown), which track can be mounted on, or in, the door or frame. The door 53 can be connected to the door frame 114 by hinges (not shown).

One feature of the invention resides broadly in the pivot-hung door drive system with an electronic control system that contains at least one memory and one microprocessor, for an at least single-panel door, the door panel of which is driven by an electro-mechanical drive unit that acts in the opening and closing directions, whereby the drive unit consists essentially of a drive motor 10 with a transmission 9 and a power transmission unit for the door connected to it, whereby the power transmission unit consists of a screw 8 with a screw nut 7 that partly surrounds the screw, which screw nut 7 is positively and non-positively connected with a toothed rack 5 and a drive shaft 22 is engaged with its gear teeth 56 in gear teeth 23 of the toothed rack 5, and the drive shaft 22 is connected with one end of an actuator lever and the pivot-hung door drive system is installed inside a door panel or inside a door frame or casing.

Another feature of the invention resides broadly in the pivot-hung door drive system characterized by the fact that the toothed rack 5 is secured to prevent it from rotating.

Yet another feature of the invention resides broadly in the pivot-hung door drive system characterized by the fact that the toothed rack 5 is non-rotationally secured by guide lugs 27, 28, 32, 33 that are located on the toothed rack 5, whereby these lugs are engaged in recesses 25, 26, 34, 35 that are located on the plates 1, 24.

Still another feature of the invention resides broadly in the pivot-hung door drive system characterized by the fact that the cover plates 1, 24 are separated on one end by a terminal piece 4 and on the other end by a bearing mount 2, and the toothed rack 5, the screw nut 7 with the screw 8 mounted in it on one end are located between the cover plates 1, 24, and the screw 8 is mounted on the other end in the bearing mount 2.

A further feature of the invention resides broadly in the pivot-hung door drive system characterized by the fact that positively and non-positively attached to the bearing mount 2 is a bearing flange 3, to which the drive motor 10 is fastened with a transmission 9 and a distance sensor 11.

Another feature of the invention resides broadly in the pivot-hung door drive system characterized by the fact that the transmission 9 is not irreversible or self-locking.

Yet another feature of the invention resides broadly in the pivot-hung door drive system characterized by the fact that the distance sensor 11 is an incremental sensor.

Still another feature of the invention resides broadly in the pivot-hung door drive system characterized by the fact that the screw 8 is a recirculating ball screw.

A further feature of the invention resides broadly in the pivot-hung door drive system characterized by the fact that the screw 8 has a locator for a drive shaft 15 of the transmission 9.

Another feature of the invention resides broadly in the pivot-hung door drive system characterized by the fact that the pivot-hung door drive system has a maximum width of 35 mm.

Yet another feature of the invention resides broadly in the pivot-hung door drive system characterized by the fact that the actuator lever is connected with its second end with a sliding block, which can move in a sliding rail, along the sliding rail, installed inside the door or inside the door frame or casing.

Still another feature of the invention resides broadly in the pivot-hung door drive system characterized by the fact that the screw nut 7 and the toothed rack 5 are one piece.

A further feature of the invention resides broadly in the pivot-hung door drive system characterized by the fact the control system 51 has an independent power supply 52.

Another feature of the invention resides broadly in the pivot-hung door drive system characterized by the fact that the power supply 52 is a storage battery.

Yet another feature of the invention resides broadly in the pivot-hung door drive system characterized by the fact the control system 51 contains a receiver 54.

Still another feature of the invention resides broadly in the pivot-hung door drive system characterized by the fact that the control system 51 is an SPS control system.

Examples of microprocessors that are part of a door system which may possibly be utilized or adapted for use in the present invention may be found in the following U.S. patents: U.S. Pat. No. 5,625,266, issued on Apr. 29, 1997 to inventor Stark; U.S. Pat. No. 5,682,023, issued on Oct. 28, 1997 to inventors McHugh, et al.; U.S. Pat. No. 5,479,151, issued on Dec. 26, 1995 to inventors Lavelle, et al.; U.S. Pat. No. 5,453,736, issued on Sep. 26, 1995 to inventor Noren; U.S. Pat. No. 5,142,152, issued on Aug. 25, 1992 to inventor Boiucaner; U.S. Pat. No. 5,140,173, issued on Aug. 18, 1992 to inventors Chau, et al.; U.S. Pat. No. 5,070,442, issued on Dec. 3, 1991 to inventors Syron-Townson, et al.; U.S. Pat. No. 4,994,724, issued on Feb. 19, 1991 to inventor Hsu; U.S. Pat. No. 4,831,509, issued on May 16, 1989 to inventors Jones, et al.; and U.S. Pat. No. 4,808,995, issued on Feb. 28, 1989 to inventors Clark, et al.

Examples of sensors or monitoring systems and/or components thereof which may possibly be utilized or adapted for use in the present invention may be found in the following U.S. patents: U.S. Pat. No. 5,625,266, issued on Apr. 29, 1997 to inventor Stark; U.S. Pat. No. 5,633,626, issued on May 27, 1997 to inventor Cawthorne; U.S. Pat. No. 5,812,391, issued on Sep. 22, 1998 to inventor Mehalshick; U.S. Pat. No. 5,070,442, issued on Dec. 3, 1991 to inventors Syron-Townson, et al.

Examples of door closers and/or components or parts thereof which may possibly be utilized or adapted for use might be found in U.S. patents: U.S. Pat. No. 5,311,642, No. 5,461,754, No. 5,417,013, No. 5,544,462, No. 5,651,216; No. 5,862,630; No. 5,832,561; No. 5,802,670; and No. 5,901,412.

Examples of control units that are part of a door system which may possibly be utilized or adapted for use in the present invention may be found in the following U.S. patents: U.S. Pat. No. 5,751,224, issued on May 12, 1998 to inventor Fitzgibbon; U.S. Pat. No. 5,105,131, issued on Apr. 14, 1992 to inventor Schap; and U.S. Pat. No. 5,039,925, issued on Aug. 13, 1991 to inventor Schap.

Examples of SPS control units and/or components thereof which may possibly be utilized or adapted for use in the present invention might be found in the following U.S. patents: U.S. Pat. No. 5,814,979; No. 4,651,273; No. 5,607, 652; No. 5,631,814; No. 5,661,648; and No. 5,659,785.

Examples of cardioid cams and/or parts or components thereof which may possibly be utilized or adapted for use in the present invention might be found in U.S. Patents: U.S. Pat. No. 5,307,657; No. 5,132,944, No. 5,059,994; No. 4,914,278; No. 4,679,105; No. 4,564,043; and No. 4,338, 681.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. DE 197 56 496.8, filed on Dec. 19, 1997, having inventor Oliver Moll, and DE-OS 197 56 496.8 and DE-PS 197 56 496.8 and International Application No. PCT/EP98/08236, filed on Dec. 16, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

NOMENCLATURE

1 Cover plate
2 Bearing mount
3 Bearing flange
4 Terminal piece
5 Toothed rack
6 Actuator cam
7 Screw nut
8 Screw
9 Transmission
10 Drive motor

11 Distance sensor
13 Bearing extension
14 Bearing mount
15 Drive shaft
16 Bearing
17 Screw bearing
18 Screw washer
19 Threaded fastener
20 Threaded fastener
21 Threaded fastener
22 Drive shaft
23 Gear teeth
24 Cover plate
25 Recess
26 Recess
27 Guide lug
28 Guide lug
29 Extension (Screw nut)
30 Blind boring
32 Guide lug
33 Guide lug
34 Recess
35 Recess
36 Thread
37 Recess
38 Recess
39 Penetration
40 Surface
41 Surface
42 Surface
43 Surface
44 Screw nut locator
45 Bearing surface
46 Bearing surface
47 Threaded boring
48 Thread
49 Cover
50 Threaded fasteners
51 Control system
52 Power supply
53 Door
54 Receiver
55 Recess
56 Gear teeth

What is claimed is:

1. A pivot-hung door drive system, said door drive system comprising:

a door frame;

a pivot-hung door being connected to said door frame;

a door actuation lever being configured and disposed to permit pivoting of said pivot hung door;

a pivot-hung door drive system;

one of said pivot-hung door and said door frame having a chamber;

said pivot-hung door drive system being disposed in said chamber and comprising:

an electro-mechanical drive unit;

said electro-mechanical drive unit being operable to pivot said pivot-hung door alternatively in an opening direction or in a closing direction;

said electro-mechanical drive unit comprising:

a drive motor;

a power transmission unit;

said power transmission unit comprising:

a rotatable drive screw;

said rotatable drive screw having an axis and a screw thread extending along said axis of said drive screw;

a toothed rack;

said toothed rack comprising a plurality of gear teeth and a screw thread for receiving said screw thread of said drive screw, with said plurality of gear teeth extending sequentially axially of said drive screw;

said drive motor being operatively connected to said drive screw to permit rotation of said drive screw, alternatively in one rotational direction or in an opposite rotational direction, to effect movement of said toothed rack, in one of two opposite axial directions of said drive screw to pivot said door in said opening direction or in said closing direction;

a door position control shaft;

said door position control shaft having an axis and a plurality of gear teeth extending away from and about said axis of said door position control shaft;

said door position control shaft being mountable with its axis in a fixed position;

said gear teeth of said door position control shaft being configured and disposed to be in mesh with said gear teeth of said toothed rack to permit rotation of said door position control shaft around said axis of said door position control shaft upon movement of said toothed rack in either axial direction of said drive screw; and said door position control shaft being connected to said door actuator lever to pivot said pivot-hung door during rotation of said door position control shaft;

said toothed rack being non-rotatably mounted with respect to said axis of said drive screw;

at least one mounting plate;

said toothed rack being configured and disposed to be mounted on said at least one mounting plate;

said at least one mounting plate comprising at least one guide recess;

said toothed rack comprising at least one guide lug; and said at least one guide recess being configured and disposed to receive said at least one guide lug to hold said toothed rack non-rotatably about said axis of said drive screw.

2. The pivot-hung door drive system according to claim 1, further comprising:

an electronic control system;

said electronic control system comprising:

a microprocessor;

said microprocessor being operably connected to said electro-mechanical drive unit to operate said electro-mechanical drive unit to rotate said drive screw in either of said rotatable directions of said drive screw;

a sensor for sensing a degree of angular rotation of said drive screw;

a memory function;

said memory function being operatively connected to said sensor and configured to receive signals from said sensor corresponding to said degree of angular rotation of said drive screw; and said memory function being configured to control operation of said microprocessor.

3. The pivot-hung door drive system according to claim 2, wherein:

said at least one mounting plate comprises at least two mounting plates;

said at least one guide lug comprises at least two guide lugs;

said door drive system comprises:

a terminal member;

a bearing mount;

said mounting plates each has a first end and a second end;

said terminal member is extendable between and connectable to said first end of each of said mounting plates;

said bearing mount is extendable between and connectable to said second end of each of said mounting plates; and said rotatable drive screw is rotatably receivable by said bearing mount with said drive screw disposed between said two mounting plates as said drive screw extends to said toothed rack.

4. The pivot-hung door drive system according to claim 3, wherein said drive motor, said sensor, said microprocessor and said memory function are supportable upon said bearing mount.

5. The pivot-hung door drive system according to claim 4, wherein said sensor is an incremental angular movement sensor.

6. The pivot-hung door drive system according to claim 3, wherein said power transmission unit is reversible and is free from self-locking.

7. The pivot-hung door drive system according to claim 3, wherein said drive screw comprises a recirculating ball screw.

8. The pivot-hung door drive system according to claim 7, wherein said drive screw comprises a locator for said drive shaft of said transmission.

9. The pivot-hung door drive system according to claim 8, wherein said pivot-hung door drive system has a maximum width of approximately 35 millimeters in a direction normal to said axis of said drive screw.

10. The pivot-hung door drive system according to claim 2, wherein said electronic control system comprises an independent power supply.

11. The pivot-hung door drive system according to claim 10, wherein said independent power supply comprises a storage battery.

12. The pivot-hung door drive system according to claim 2, wherein said electronic control system comprises a receiver.

13. The pivot-hung door drive system according to claim 2, wherein said electronic control system comprises a self-programming control system.

14. The pivot-hung door drive system according to claim 1, wherein said pivot-hung door drive system further comprises:

a slidable block;

said slidable block being slidably receivable by said one of said door and door frame not having said chamber; and said one end of said door actuation lever being pivotally connected to said slidable block.

15. The pivot-hung door drive system according to claim 7, wherein:

said toothed rack includes a nut member;

said nut member has one surface formed with said screw thread of said toothed rack for receiving said screw thread of said drive screw and said nut member is screw-threadedly receivable by said toothed rack.

* * * * *

UNITED STATES PATENT AND TRADEMARK OFFICE

CERTIFICATE OF CORRECTION

PATENT NO. : 6,223,469 B1
DATED : May 1, 2001
INVENTOR(S) : Oliver Moll

It is certified that error appears in the above-identified patent and that said Letters Patent is hereby corrected as shown below:

Column 14,
Line 26, before 'wherein:' delete "7," and insert -- 1, --.

Signed and Sealed this

Seventh Day of May, 2002

*Attest:*

*Attesting Officer*

JAMES E. ROGAN
*Director of the United States Patent and Trademark Office*